US006083128A

United States Patent [19]

Young et al.

[11] Patent Number: 6,083,128

[45] Date of Patent: Jul. 4, 2000

[54] AERIAL TOY

[76] Inventors: Randall K. Young; Rita A. Young, both of 3030 Halfmoon Valley Rd., Port Matilda, Pa. 16870

[21] Appl. No.: 09/079,470

[22] Filed: May 15, 1998

[51] Int. Cl.[7] ..... A63B 43/02

[52] U.S. Cl. ..... 473/576; 446/34; 446/475; 124/5

[58] Field of Search ..... 473/574, 575, 473/576, 588, 589, 613; 124/4, 5, 29, 41.1; 446/34, 475; 119/707

[56] References Cited

U.S. PATENT DOCUMENTS

| | | | |
|---|---|---|---|
| 1,075,041 | 10/1913 | Kirkness | 124/5 |
| 1,175,035 | 3/1916 | Wooster | 124/5 |
| 1,513,773 | 11/1924 | Thompson | 473/576 |
| 2,490,802 | 12/1949 | Hanff, Jr. | 124/4 |
| 3,115,129 | 12/1963 | Merriman | 124/5 |
| 3,393,911 | 7/1968 | Lawson | 473/576 |
| 4,151,674 | 5/1979 | Klahn et al. . | |
| 4,657,253 | 4/1987 | Lerner et al. | 473/576 |
| 4,696,472 | 9/1987 | Meyer | 473/575 |
| 4,790,788 | 12/1988 | Hill | 473/589 |
| 4,826,179 | 5/1989 | Callaghan . | |
| 5,230,650 | 7/1993 | Brayton . | |
| 5,421,584 | 6/1995 | Planinc et al. | 473/589 |
| 5,538,456 | 7/1996 | Liu et al. . | |
| 5,655,777 | 8/1997 | Neading et al. . | |
| 5,903,924 | 5/1999 | Garbit | 473/575 |

*Primary Examiner*—Steven Wong
*Attorney, Agent, or Firm*—John J. Elnitski, Jr.

[57] ABSTRACT

The present invention provides an aerial toy for entertainment, recreation and coordination development. The toy is intended to be thrown and caught, but has additional features that the user can employ to provide other imaginative forms of play with the toy. The aerial toy provides for games of catching and throwing of the toy; launching insertable objects such as a ball from the toy; and launching and delivery of different payloads. The multiple features of the aerial toy provide for the freedom and imaginative expression of the user for the user's amusement. Also, the toy can be used for marketing of products and services.

26 Claims, 13 Drawing Sheets

AERIAL TOY

BACKGROUND

Aerial toys with tails or balls launched with slings are popular with both children and adults. Today, one of the more popular types of aerial toys include a colorful tail permanently attached to either a ball or an enclosed weighted end. The toy is propelled through the air either by throwing the weighted end or by twirling the tail at the end opposite of the weighted end and then releasing the toy. The ball or weighted end is not releasable from the tail. The toy industry is interested in toys that have multiple functions and expand the imaginative play of the user. The play of the aerial toys mentioned above is limited by their form and inability to be transformed by the user for other forms of play.

It is an object of the present invention to provide an aerial toy which has multiple applications of play.

It is another object of the present invention to provide an aerial toy which allows the user to modify the attributes of the toy and discover new ways to play with the toy using the user's imagination.

Finally, it is an object of the present invention to provide a toy which can be used for marketing of products and services.

SUMMARY OF THE INVENTION

The present invention provides an aerial toy which includes a weighted nose and a tail extending from the nose. The nose includes an open front end. The toy also includes an insertable object which is insertable into the open front end of the nose. A unique feature of the toy is a removable bag acting as said tail. The bag is attached to the nose using a removable bag retainer which fits into the an open rear end of the nose. The bag and bag retainer remain in the nose due to friction. The toy also includes ways of carrying payloads such as webbed pouches and compartments in the bag.

DETAILED DESCRIPTION

The present invention provides an aerial toy for entertainment, recreation and coordination development. The toy is intended to be thrown and caught, but has additional features that the user can employ to provide other imaginative forms of play with the toy. The aerial toy provides for games of catching and throwing of the toy; launching insertable objects such as a ball from the toy; and launching and delivery of different payloads. The multiple features of the aerial toy provide for the freedom and imaginative expression of the user for the user's amusement. Also, the toy can be used for marketing of products and services.

Figure 1:
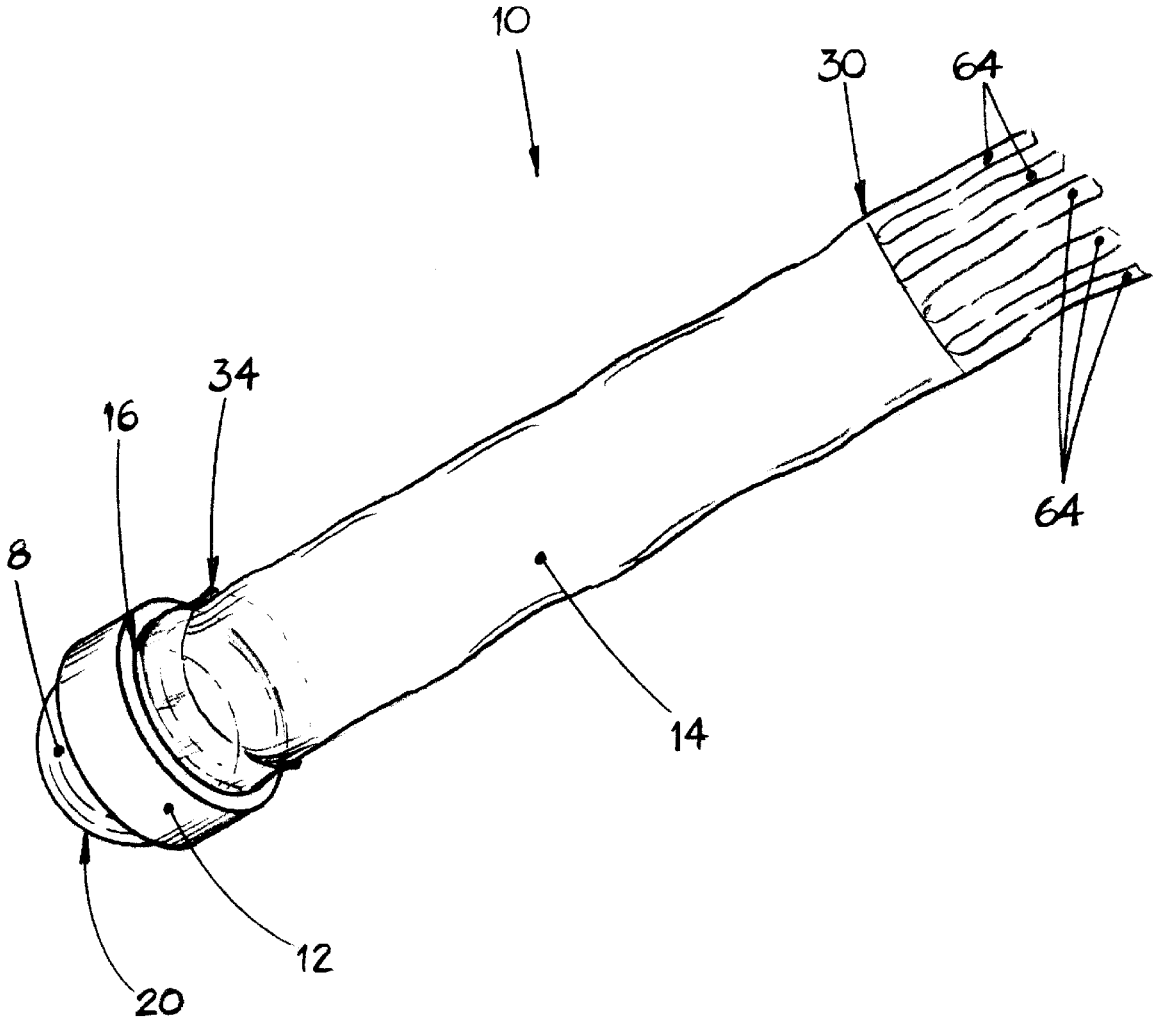
FIG. 1 is a perspective view from an aerial toy according to the present invention.
Figure 2:
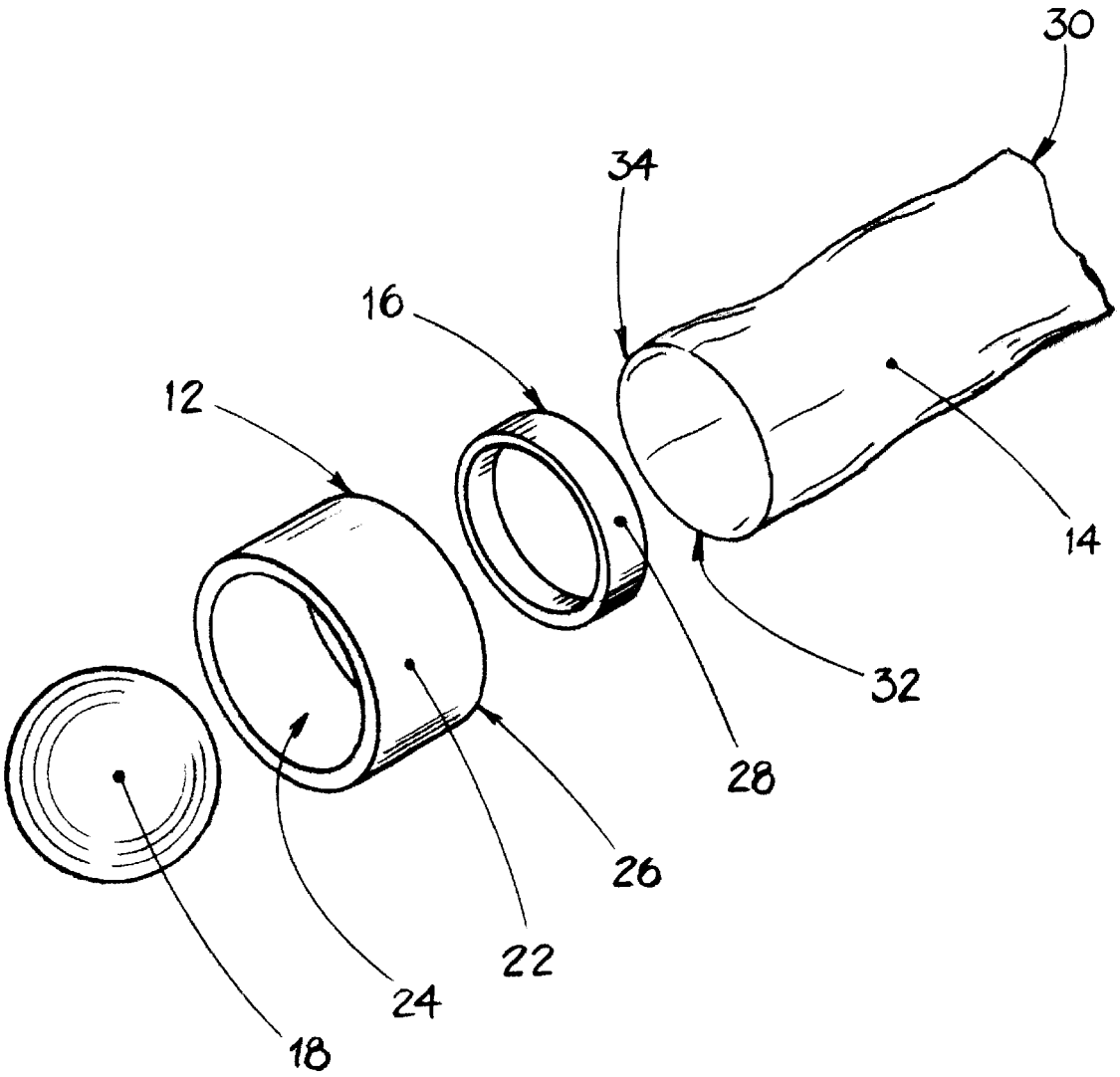
FIG. 2 is an exploded view of the toy shown in FIG. 1.
Figure 3:
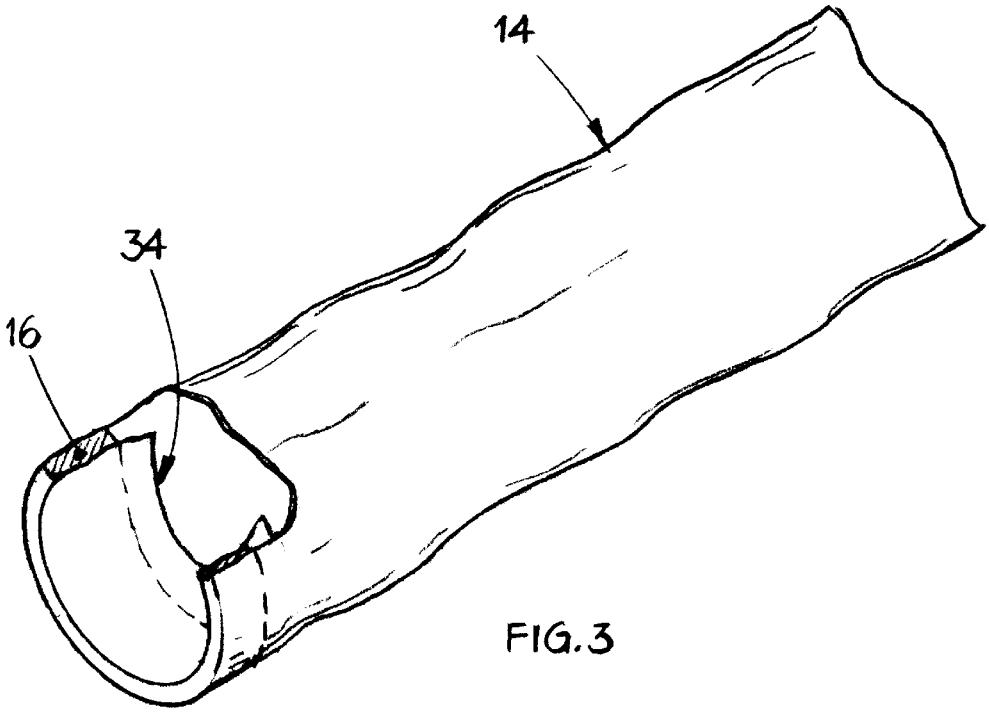
FIG. 3 is a perspective cutout view of a bag and a bag retainer according to the present invention.
Figure 4:
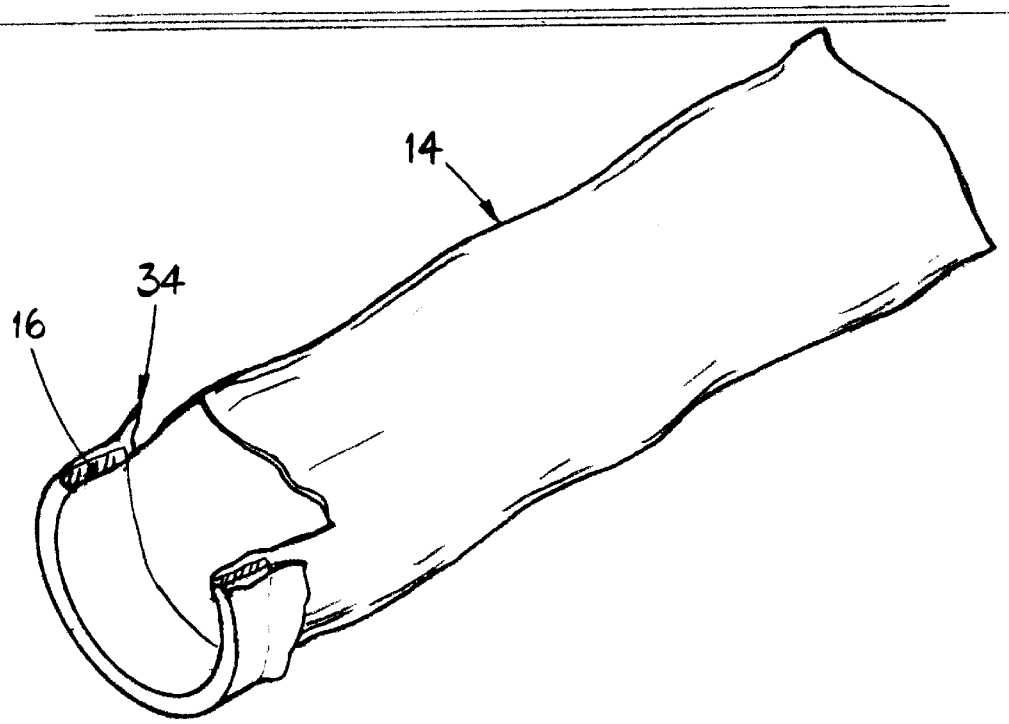
FIG. 4 is a perspective cutout view of a bag and a bag retainer according to the present invention.

FIGS. 1–15 depict the aerial toy 10 with different embodiments of components of the toy 10. The three main components of the toy 10 are a nose 12, a removable bag 14 and removable bag retainer 16, of which an embodiment of each component is shown in FIGS. 1–4. FIGS. 1–2 also show a ball 18 as an insertable object 20. The nose 12 shown in FIGS. 1–2 is an open ended cylinder 22 having an open front end 24 and an open rear end 26. The bag retainer 16 is a smaller open ended cylinder 28 which fits snugly into the rear end 26 of the nose 12. The bag retainer 16 remains in the nose 12 due to the frictional pressure fit of the two cylinders 22 and 28, yet is removable to replace the bag 14. The bag 14 shown in FIGS. 1–4 has a sealed rear end 30 and an open front end 32. Bag 14 act as a tail on the toy 10. The bag's front end 32 is placed inside the inside diameter of the bag retainer 16 and an edge 34 of the bag's front end 32 is wrapped around the outside diameter of the bag retainer 16 as shown in FIG. 4. The bag's front end 32 could also be placed around the outside of the bag retainer 16 and the edge 34 of the bag's front end 32 wrapped into the inside of the bag retainer 16, as shown in FIG. 3. Once the bag 14 is wrapped around the bag retainer 16, the bag retainer 16 is forced inside the nose 12. The pressure fit of the assembled bag 14, bag retainer 16 and nose 12 holds the components of the toy 10 together for play. Also, glue can be applied to the nose 12 and bag retainer 16 (not shown), or a peg can be inserted through a hole in each the nose 12 and bag retainer 16 (not shown) to secure the components together. The front end 24 of the nose 12 allows the insertion of different objects 20, such as the ball 18 shown in FIGS. 1–2.

Figure 5:
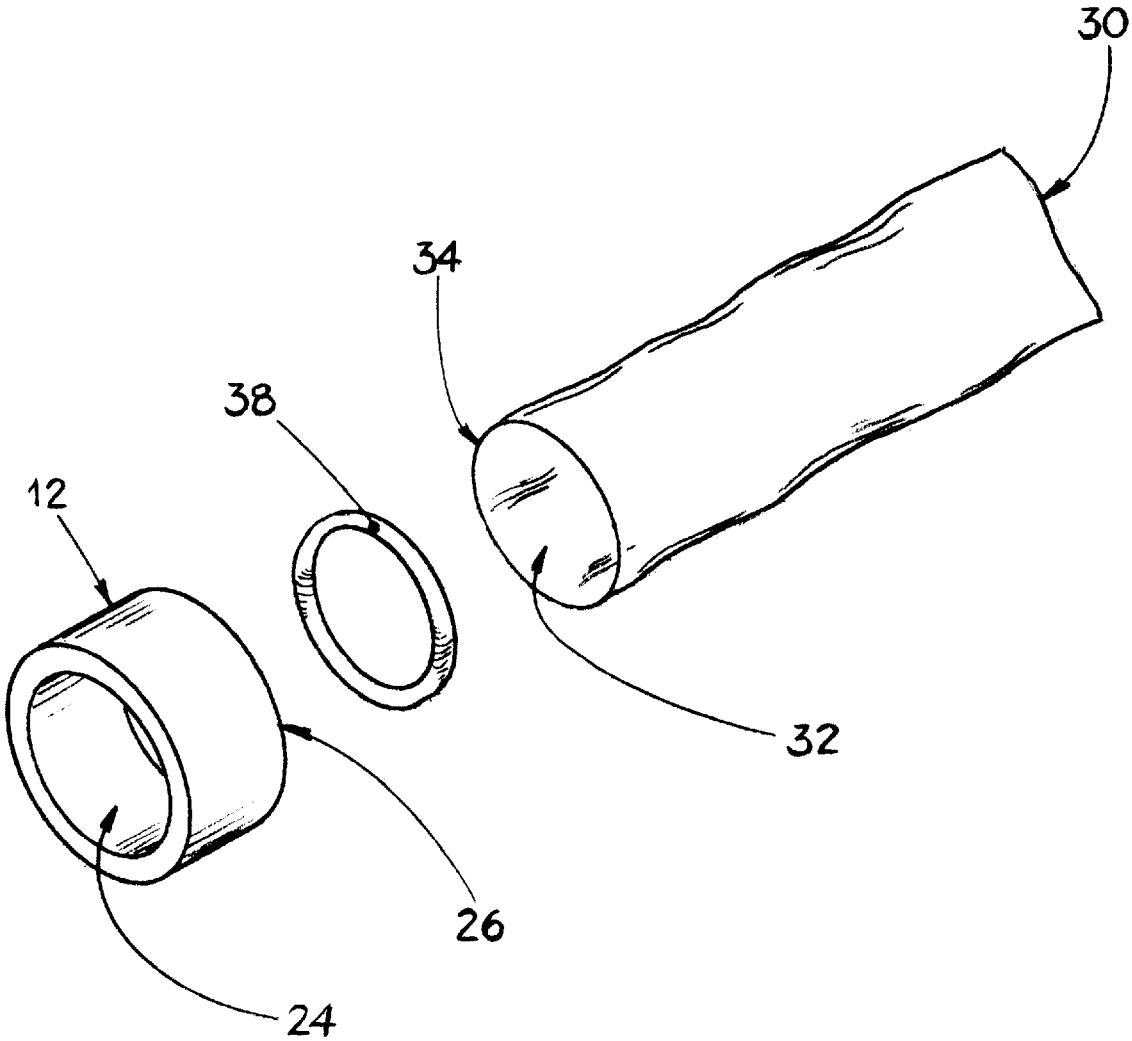
FIG. 5 is an exploded view of the toy shown in FIG. 1 with a different bag retainer according to the present invention.
Figure 6:
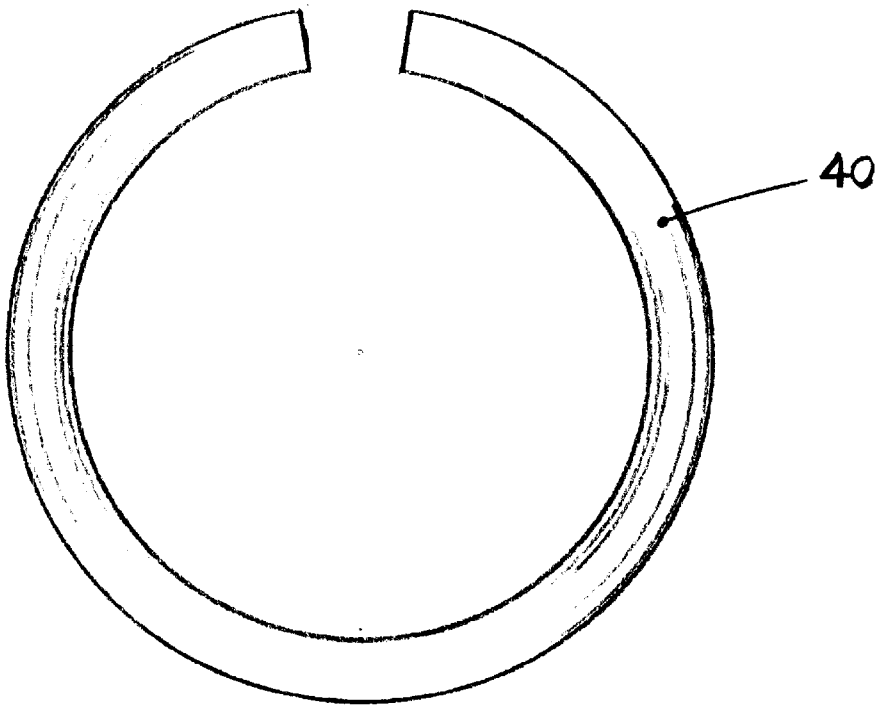
FIG. 6 is a side view of a bag retainer ring with a split according to the present invention.
Figure 7:
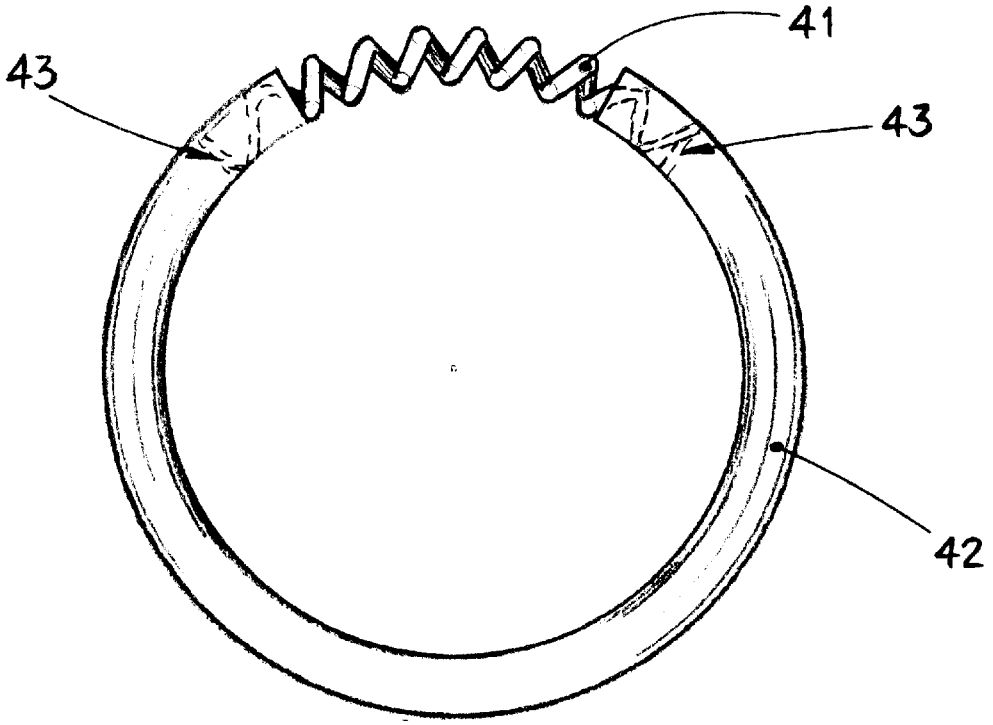
FIG. 7 is a side view of a bag retainer ring with a split and spring according to the present invention.
Figure 8:
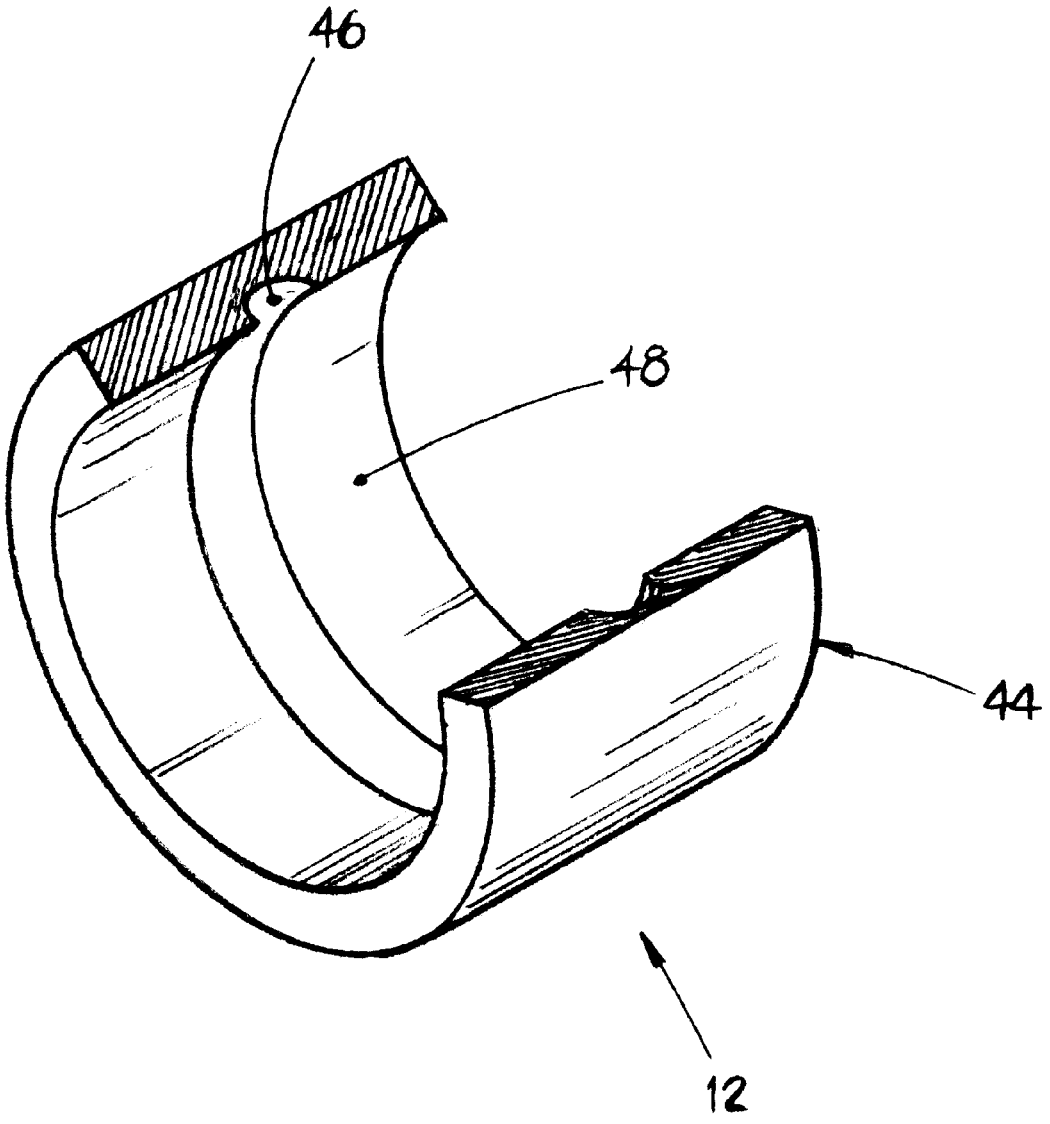
FIG. 8 is a cutout perspective view of a nose with a groove according to the present invention.
Figure 9:
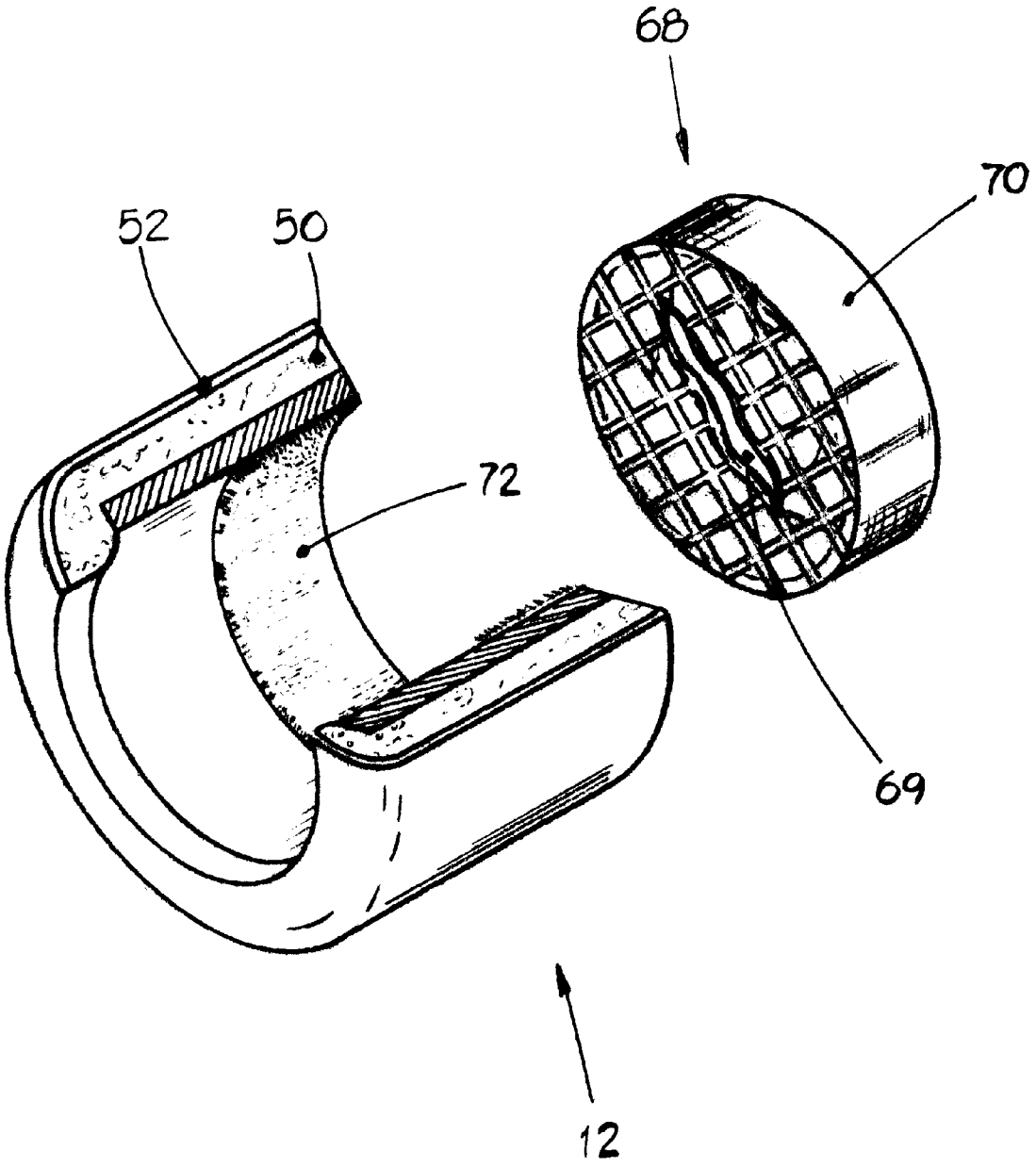
FIG. 9 is a cutout perspective view of a nose and webbed pouch according to the present invention.

Other nose 12 and bag retainer 16 combinations are shown in FIGS. 5–9. FIG. 5 shows the bag retainer 12 in the form of a ring 38 that can be pressure fitted into the nose 12 as a substitute for the smaller cylinder 28 shown for the bag retainer 16. The ring 38 can be of a flexible or non-flexible material, as long as it can be pressed into the nose 12 and retained in the nose 12 due the friction of a pressure fit. As shown in FIGS. 6–7, a split ring 40 and a spring loaded ring 42 are other possible ring embodiments of the bag retainer 16. The spring loaded ring 42 includes a spring 41 within the ring 42 that is positioned between two stops 43. The bag 14 is wrapped around any of the ring embodiments by either method described above for the smaller cylinder embodiment of the bag retainer 16. A grooved nose 44 is a another embodiment of the nose 12, as shown in FIG. 8. The grooved nose 44 includes a groove 46 in the inside diameter 48 of the nose 44. The groove 46 is sized to accept the any possible ring embodiments for the bag retainer 16. The groove 46 allows for the ring 38 to be pressed into the groove 46 and expand into the groove 46. The groove-ring combination provides a more secure method of retaining the toy's components as one unit, yet allows for disassembly of the components. FIG. 9 shows the nose 12 encased in a foam 50 and rubber band 52 combination. The rubber band 52 is used to retain the foam 50 on the nose 12 and protect the foam 50 from damage. The foam 50 provides a soft layer of cushioning to prevent damage to something that the nose 12 might hit during use of the toy 12. Other materials known in the art can be used as protective cushioning for the nose 12, as well known ways of securing such materials to the nose 12.

The aerial toy 10 can be played without an object 20 in the nose 12, with an object 20 in the nose 12 and with different payloads. Play with the aerial toy 10 with and without an object 20 is similar to the prior art toys with a weighted end as described above. The aerial toy 10 can be propelled through the air either by throwing the nose 12 or by twirling the bag 14 and then releasing the toy 10. With an object 20 in the nose 12 and propelling the aerial toy 10 as described above, the toy 10 acts similarly to toys of the prior art. Without an object 20 in the nose 12, the aerial toy 10 behaves differently than prior art toys. By varying the form of the bag 14, the flight of the aerial toy 10 can be modified and controlled, where the prior art toys cannot. The bag 14 shown in FIGS. 1–4 actually inflates during flight and affects the flight of the aerial toy 10 as compared to prior art toys. The bag 14 inflates in flight due to the sealed rear end 30 when there is no object 20 in the nose 12. Simple modifications to the bag 14 such as changes in material, weight and volume of the bag 14 affect flight characteristics of the toy 10. Also, the bag 14 shown in FIGS. 1–4 can be inflated prior to flight and maintained in an inflated state if an object 20 such as a ball or balloon is inserted into the nose 12 after the bag 14 has been inflated.

Figure 10:
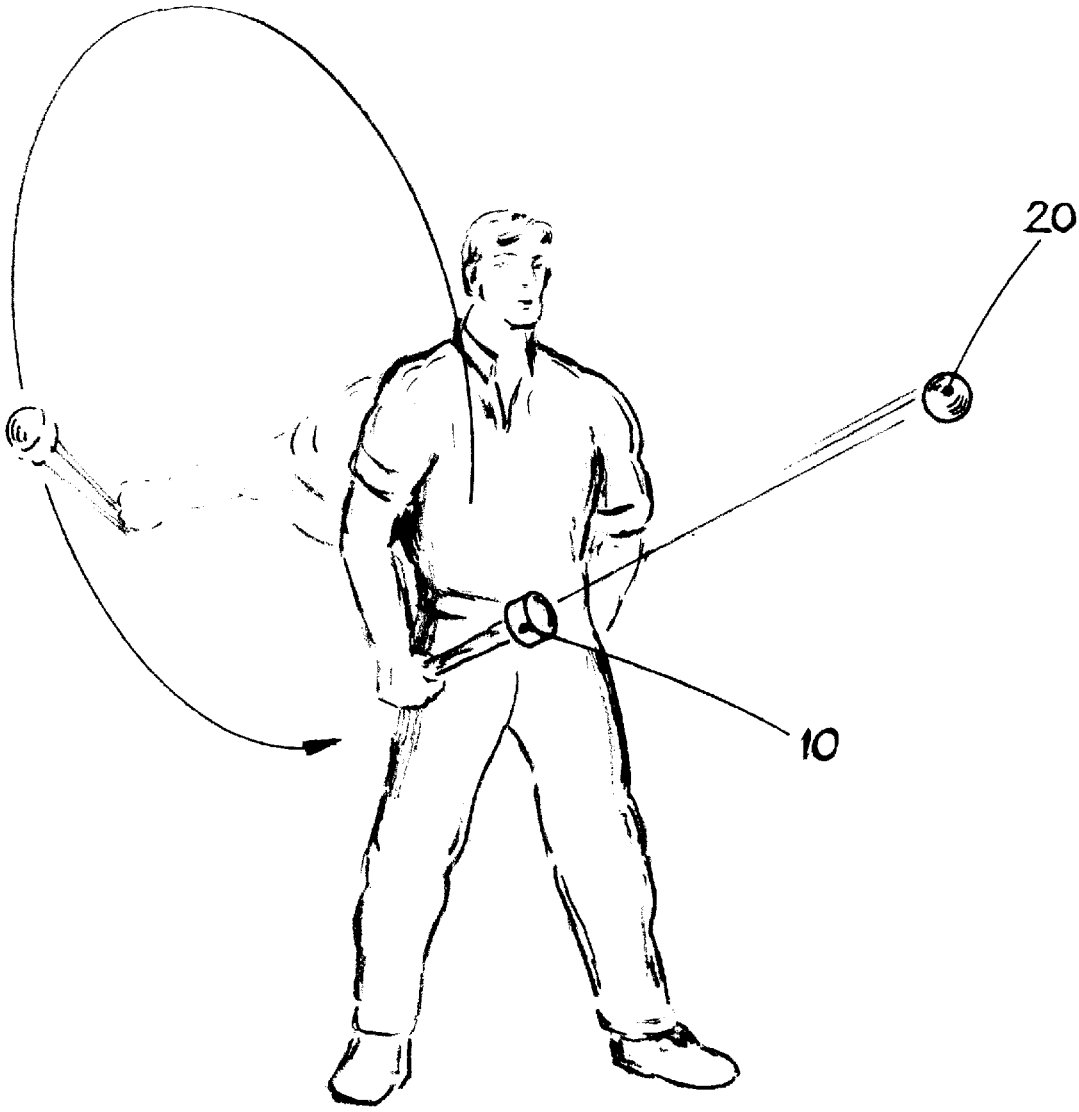
FIG. 10 is a perspective view of launching an object using the toy according to the present invention.
Figure 11:
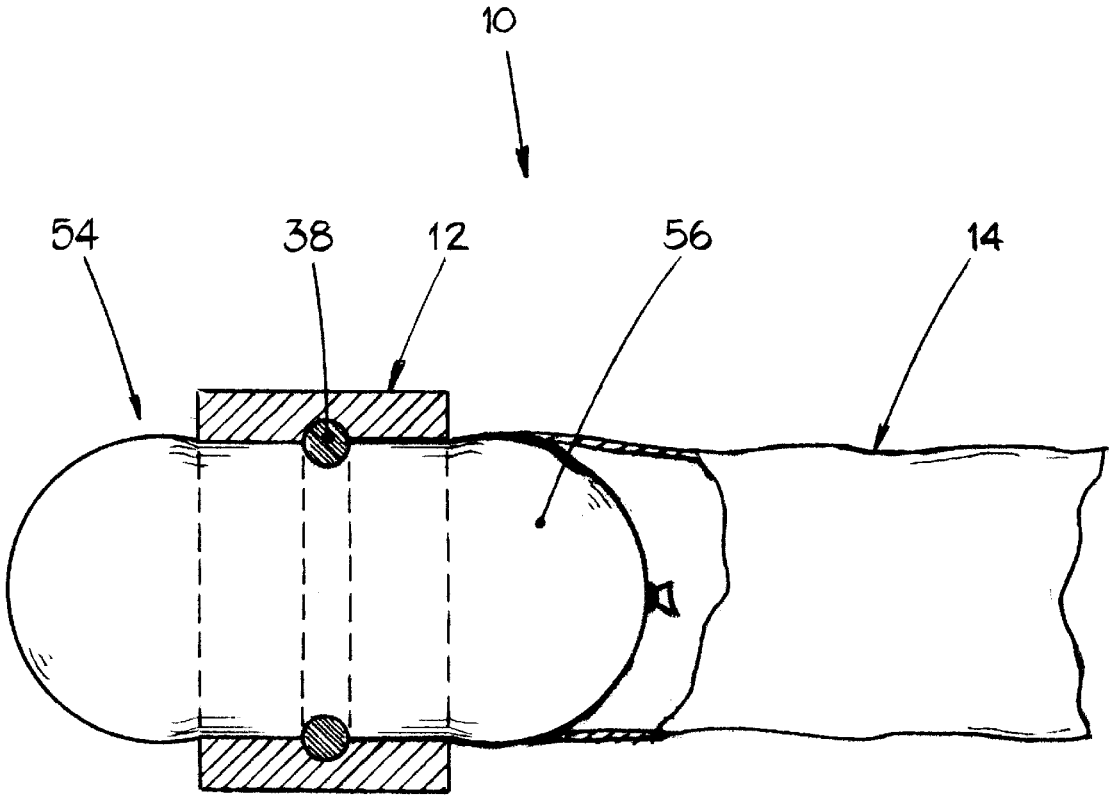
FIG. 11 is a cutout side view of a nose, bag, bag retainer and balloon according to the present invention.

A unique feature of the aerial toy 10 is that the object 20 inserted in the nose 12 can be launched from the toy 10. The toy 10 utilizes the pliability of the object 20 to retain the object 20 in the nose 12 and to allow the release of the object 20 for launching, if enough force is applied. After the object 20 is inserted into the nose 12, friction between the pliable object 20 and the inside surface of the nose 12 holds the object 20 in place. The object 20 will remain in the nose 12 due to frictional forces, when the toy 10 is thrown by the nose 12 or twirled by the bag 14 and then released. The object 20 can be launched by employing centripetal force and converting that force to overtake the frictional bond of the object 20 and the nose 12. Launching of the object 20 is achieved by twirling the toy 10 by the rear end 30 of the bag 14 and then stopping the twirling motion by snapping the bag 14 without releasing the toy 10, as shown in FIG. 10. After practicing this motion, the user can learn to aim and the launch object 20 in a desired direction towards a desired target. Examples of objects insertable into the nose 12 are balls, foam missiles, and balloons. The balls that can be used include soft foam balls, foam-ball filled balls or bags, sponge rubber balls, water-filled balls and Velcro covered balls. Balloons inserted in the nose 12 can be air filled, odor filled, material filled or water filled. FIG. 11 shows a balloon 54 retained in the nose 12 due to a section 56 of the balloon 54 protruding beyond the bag retainer ring 38 and into the bag 14. The balloon section 56 would be inflated to a diameter larger than inside diameter of the bag retainer ring 38, enabling a staying force to retain the balloon 54 in the nose 12. The amount of inflation of the balloon section 56 beyond the bag retainer ring 38 would determine the necessary force needed to remove or launch the balloon 54 from the toy 10.

Figure 12:
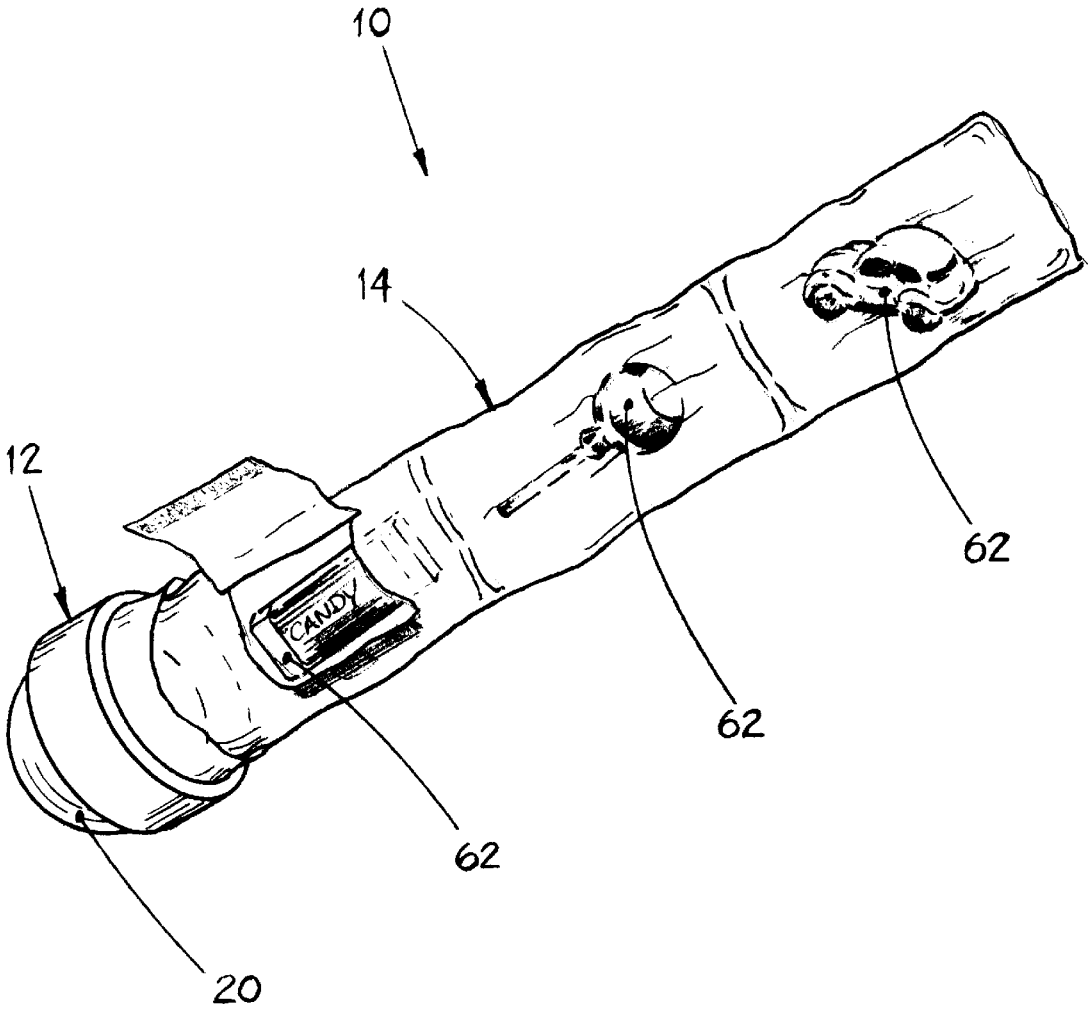
FIG. 12 is a perspective view of an aerial toy with compartments in a bag according to the present invention.

There can be many variations (not shown) on the bag 14 used with the aerial toy 10. The bag 14 can include compartments 60 for retaining articles 62 as shown in FIG. 12. The compartments 60 can be sealed or they can allow access by the user. The bag 14 can be of different shapes and material to affect flight of the toy 10. As shown in FIG. 1, ribbons 64 attached on the rear end 30 of the bag 14 can be used as a handle for twirling the toy 10 or to affect the flight characteristics or appearance of the toy 10. The bag 14 can hold water which can be launched along with the object 20 as described above. A unique feature of the toy 10 is that the user can add their own bags and modifications to the bag 14 to affect the play of the toy 10. The utilization of a removable bag 10 as a tail for the toy 10 enables rapid changes in appearance the toy 10. Different size and shape bags can be attached for various aerodynamic actions and reactions. Additionally, to affect the flight of the toy 10, air deflectors (not shown) can be added or inserted into the bag 14, or the bag 14 can have an open rear end instead of the sealed rear end 30 to allow air to flow through the toy 10 as it is flying.

Figure 13:
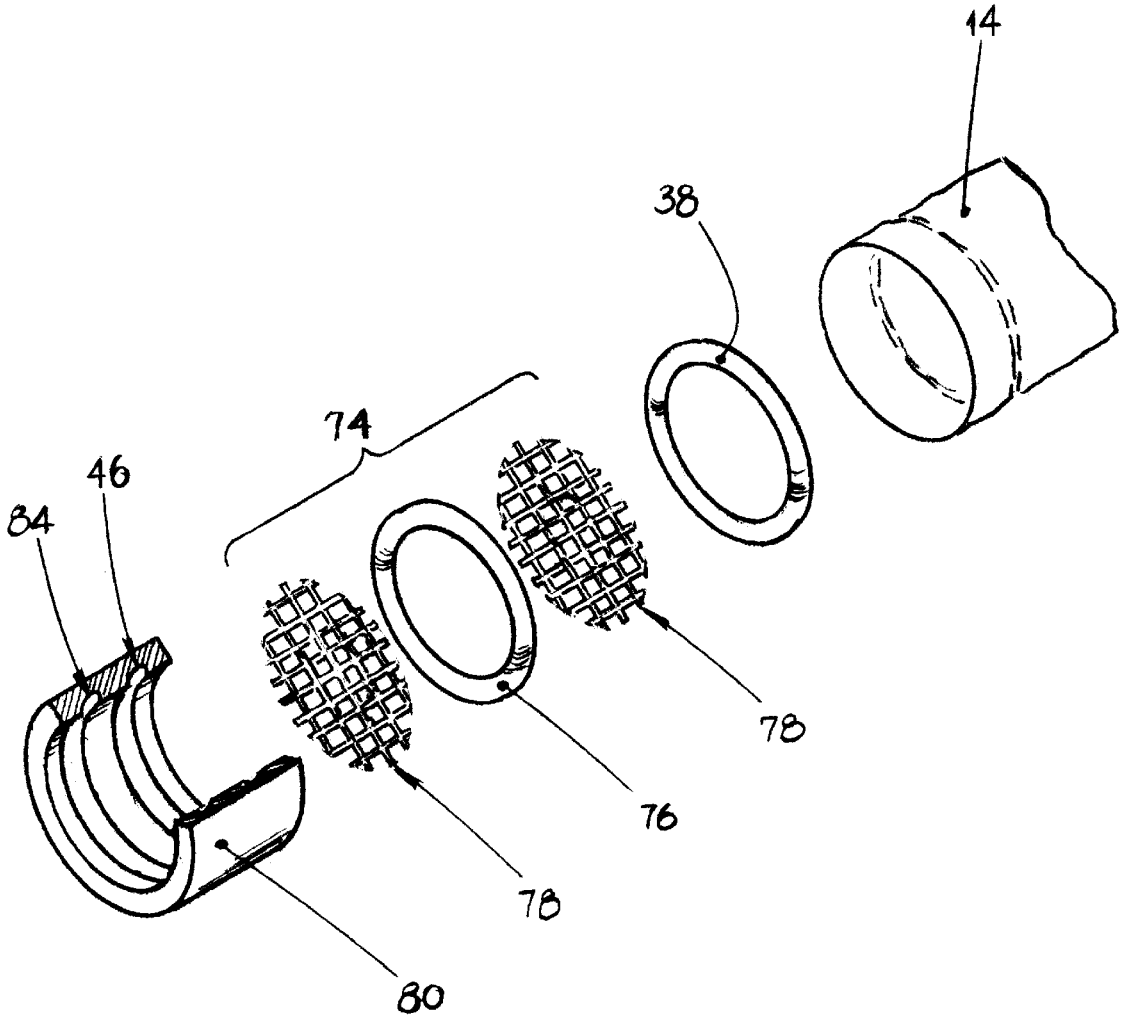
FIG. 13 is a perspective exploded and cutout view of a nose and webbed ring pouch according to the present invention.
Figure 14:
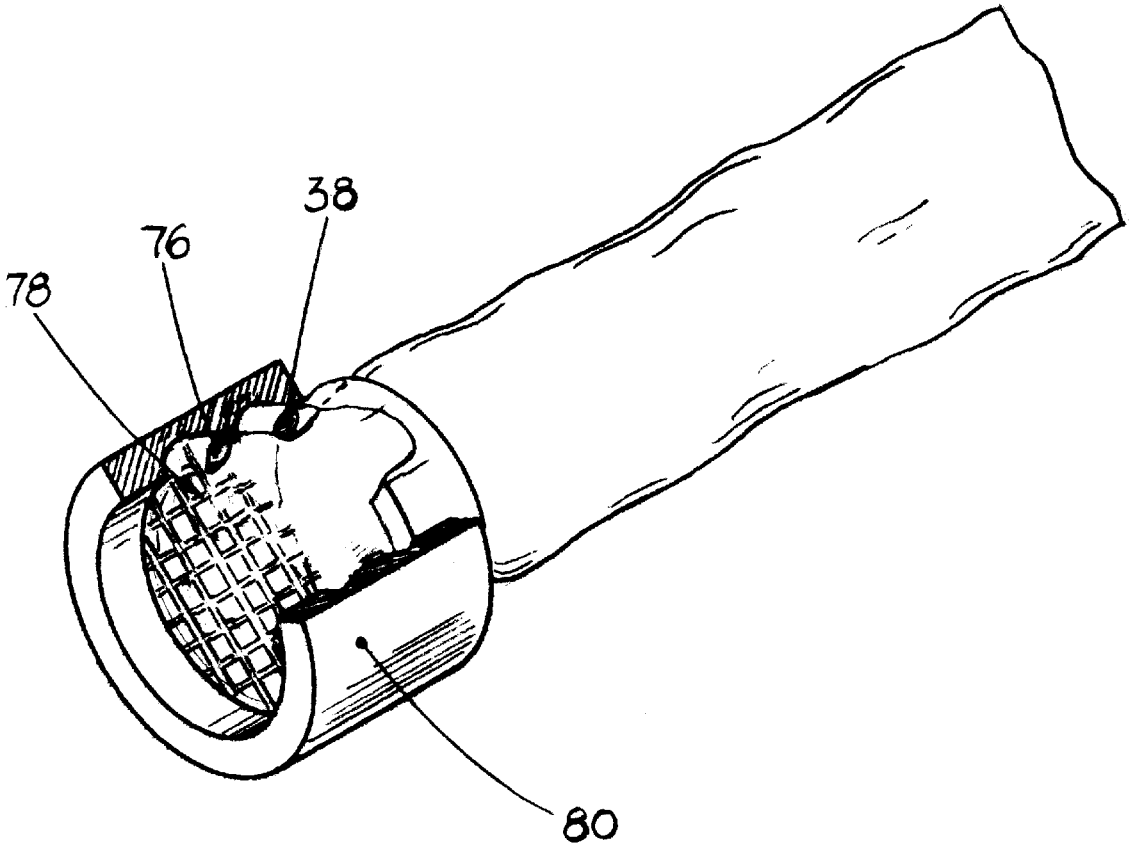
FIG. 14 is a perspective cutout view of a nose and webbed ring pouch according to the present invention.
Figure 15:
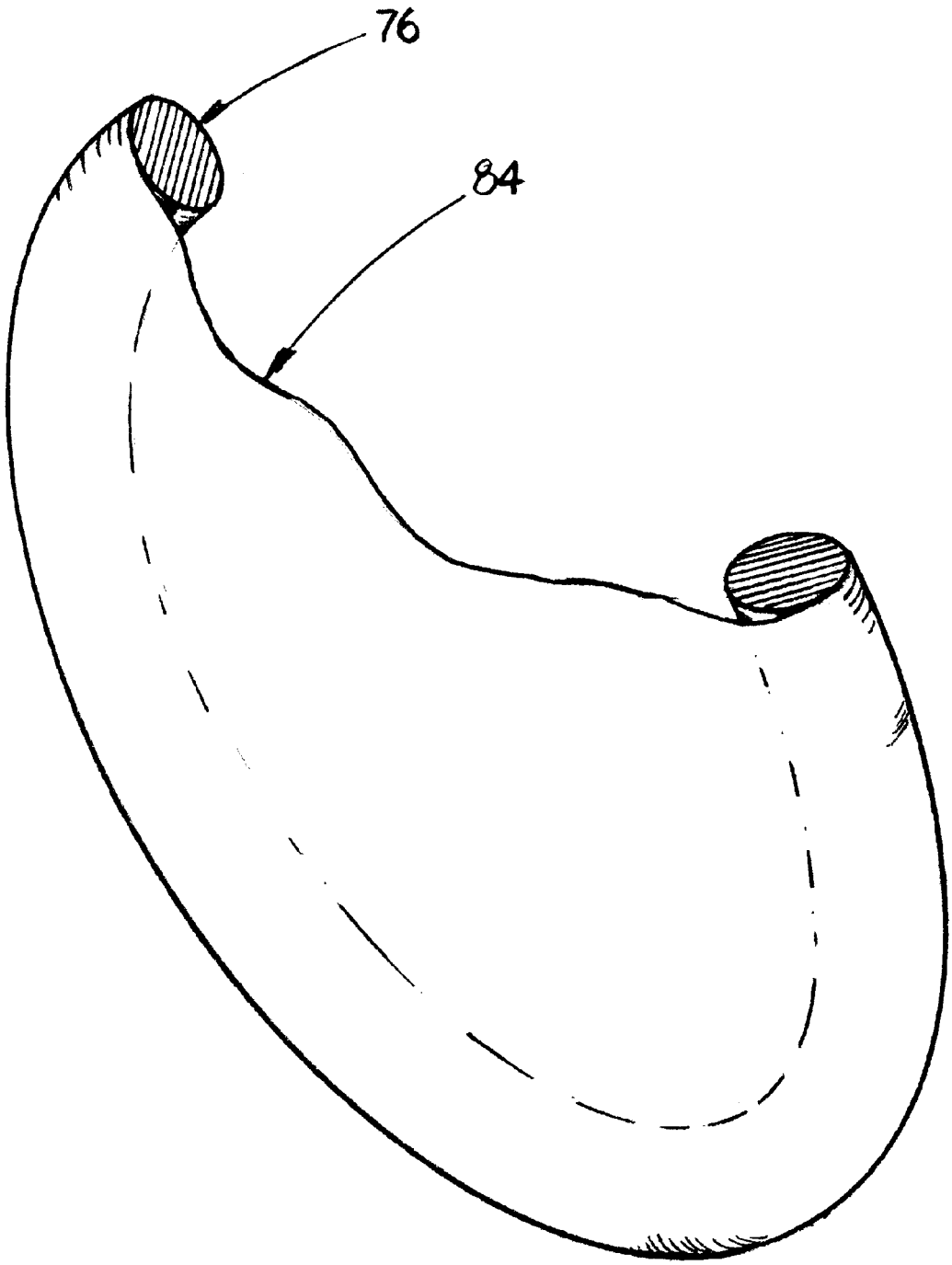
FIG. 15 is a perspective cutout view of a ring and breakable membrane according to the present invention.

Besides launching an object 20, the nose 12 and bag 14 can each carry payloads. The toy 10 can act as a delivery device by inserting things into the bag 14, in a compartment 60 of the bag 14 or in the nose 12. An object 20 in the nose 12, such as the ball 18, acts to seal any type of payload in the bag 14 during flight. Notes, smells, water, candy are examples of possible payloads. Payloads or the insertable object 20 can be carried by the toy 10 which interact with external devices such as goals, catching devices and targets. Also, sensors can be carried as a payload to keep score, determine accuracy, time of flight, length of throw, proximity to targets. FIG. 9 shows a webbed pouch 68 which allows articles to be placed in the webbed pouch 68 through a slit 69. The webbed pouch 68 has Velcro 70 around the pouch's outside diameter which sticks to Velcro 72 inside the nose 12, as shown in FIG. 9. The webbed pouch 68 allows air to flow past the article in the pouch 68 and into the bag 14. Examples of articles placed in the pouch 68 are reflectors or flashing lights that allow the use of the toy 10 in the darkness. FIGS. 13–14 shows a webbed ring pouch 74 which is another embodiment of the webbed pouched 68. The webbed ring pouch 74 includes a ring 76 similar to the ring employed for the bag retainer 16 and two webbed sheets 78 attached to each side of the ring 76. The webbed ring pouch 74 is pressure fitted into the nose 12 prior to installing the bag retainer 16. FIGS. 13–14 shows a multi-grooved nose 80 that has two grooves 82 and 46, which is another embodiment of the nose 12. The groove 82 accepts the webbed ring pouch 74 and the other groove 46 accepts the bag retainer ring 38. Also, the webbed sheets 78 on the ring 76 can be replaced by a breakable membrane 84 or the breakable membrane 84 can be attached to any of the embodiments of the bag retainer 16 (not shown). The breakable membrane 84 would be strong enough to retain water in the bag 14, but would break under the force from the water when the toy 10 is snapped as described above for the launching of the object 20. This would allow the firing of the water in a desired direction towards a desired target.

The aerial toy 10 can be utilized for inspiring the creativity of the user. Small appendages can be added and inflated from the bag 14. Feathers, foam ball, glitter, markers, paints, and other decorative items can be applied, inserted or adhered to the bag to accent the bag's appearance. The variety of games that can be played with the aerial toy 10 are endless. Both individual games as well as group/team games, classical games and games unique to this toy 10 can also be developed. New versions of wall ball, ultimate, Frisbee golf, Velcro throw, etc. are instantly enhanced when the features of the toy 10 are utilized. The freedom of changing the toy 10 instantly changes the strategies and actions involved in any game. The aerial toy 10 also has a broader market than just the use as a toy 10 due to its diverse appearance potential. The toy 10 provides an inexpensive display for the marketing of products and services by simply printing advertising on the bag 14. Payloads inside of the bag can be products or advertisements.

While embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of the appended claims and any and all equivalents thereof.

We claim:

1. An aerial toy comprising:

a weighted nose, said nose including an open front end and an open rear end a tail extending from said rear end of said nose;

at least one compartment as part of said tail to contain at least one payload;

a removable bag retainer which fits into said open rear end and remains in said nose due to friction; and a removable bag acting as said tail, said bag including a front end and a rear end, said front end of the bag being attached to said bag retainer.

2. The toy of claim 1, wherein said nose is an open ended cylinder.

3. The toy of claim 1, wherein said bag retainer is an open ended cylinder.

4. The toy of claim 1, wherein said bag includes an open front end and a sealed rear end.

5. The toy of claim 1, wherein said bag includes an open front end and an open rear end.

6. The toy of claim 1, wherein said bag includes an open front end attached to said bag retainer and a rear end, wherein said front end of the bag is inside the bag retainer and wherein an edge of said front end of the bag is wrapped around an outside surface of said bag retainer prior to the fitting of said bag retainer into said nose.

7. The toy of claim 1, wherein said bag includes an open front end attached to said bag retainer and a rear end, wherein said bag retainer is inside said front end of the bag and an edge of said front end of the bag is wrapped around an inside surface of said bag retainer prior to the fitting of said bag retainer into said nose.

8. The toy of claim 1, further including a handle attached to said rear end of said tail.

9. The toy of claim 8, wherein said handle is at least one ribbon.

10. The toy of claim 1, further including a cushion attached about an outside surface of the nose to protect objects that the nose may strike.

11. The toy of claim 10, wherein said cushion is retained to said nose by a rubber band.

12. An aerial toy comprising:

a weighted nose, said nose including an open front end and a rear end a tail extending from said rear end of said nose;

at least one compartment as part of said tail to contain at least one payload;

an insertable object which is insertable into said open front end; and a liquid in said tail, wherein said tail is liquid proof so it can retain said liquid and wherein said insertable object serves to seal said liquid within said toy.

13. An aerial toy comprising:

a weighted nose, said nose including an open front end and a rear end;

a tail extending from said rear end of said nose;

a removable bag retainer which fits into said open rear end and remains in said nose due to friction;

a removable bag acting as said tail, said bag including a front end and a rear end, said front end of the bag being attached to said bag retainer; and a webbed pouch fitted inside said nose between said front end of the nose and said bag retainer.

14. The toy of claim 13, wherein said webbed pouch includes a ring enclosed on both sides of said ring by a webbing material to form said webbed pouch.

15. The toy of claim 14, wherein said nose includes a groove on an inside surface of said nose to accept and retain said ring of said webbed pouch.

16. The toy of claim 12, wherein said insertable object is a ball.

17. The toy of claim 12, wherein said insertable object is a balloon.

18. The toy of claim 1, wherein said bag retainer is a ring.

19. The toy of claim 18, wherein said ring includes a split in said ring so that said ring can be compressed.

20. The toy of claim 19, wherein said ring includes a spring within said split so that said ring expands after being compressed and released.

21. The toy of claim 1, wherein said nose further includes a groove to receive and retain said bag retainer.

22. An aerial toy comprising:

a weighted nose, said nose including an open front end and a rear end a tail extending from said rear end of said nose;

at least one compartment as part of said tail to contain at least one payload; and a breakable membrane, said membrane sealing a front end of said tail which is attached to said rear end of said nose.

23. A method of launching an insertable object from an aerial toy, having a weighted nose with an open front end, a rear end and a tail which is liquid proof extending from the rear end, comprising:

a. filling the tail with a liquid;

b. inserting the object into the open front end of the nose;

c. grasping the aerial toy by the tail d. twirling the aerial toy by the tail in a circular motion;

e. snapping the aerial toy by the tail and halting the circular motion of the aerial toy;

f. causing the object and the liquid to be released and launched due the force of the snapping and halting of the circular motion in step (e).

24. The method of claim 23, wherein said object is pliable.

25. The method of claim 23, wherein said object is a ball.

26. The method of claim 23, wherein said object is a balloon.

* * * * *